US008246365B2

(12) United States Patent
Shishikura et al.

(10) Patent No.: US 8,246,365 B2
(45) Date of Patent: Aug. 21, 2012

(54) LEVER-TYPE CONNECTOR

(75) Inventors: Seiji Shishikura, Chiba (JP); Kazushige Sakamaki, Tokyo (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 62 days.

(21) Appl. No.: 12/909,359

(22) Filed: Oct. 21, 2010

(65) Prior Publication Data

US 2011/0034049 A1 Feb. 10, 2011

Related U.S. Application Data

(63) Continuation of application No. PCT/JP2009/057170, filed on Apr. 8, 2009.

(30) Foreign Application Priority Data

Apr. 21, 2008 (JP) ..... 2008-110544

(51) Int. Cl.
*H01R 13/62* (2006.01)

(52) U.S. Cl. ..... 439/157

(58) Field of Classification Search ..... 439/157, 439/489, 152, 607.01, 357, 752
See application file for complete search history.

(56) References Cited

U.S. PATENT DOCUMENTS 5,928,010 A * 7/1999 Katsuma et al. ..... 439/157
6,241,540 B1 6/2001 Tokuwa
6,319,050 B1 * 11/2001 Miyazaki et al. ..... 439/489
6,325,647 B1 * 12/2001 May et al. ..... 439/157
6,623,286 B2 * 9/2003 Tachi ..... 439/157
6,623,287 B2 * 9/2003 Hatagishi et al. ..... 439/157
6,733,312 B2 * 5/2004 Fujii ..... 439/157
6,764,324 B2 * 7/2004 Shinozaki et al. ..... 439/157
(Continued)

FOREIGN PATENT DOCUMENTS

EP 1653564 A2 5/2006
(Continued)

OTHER PUBLICATIONS

International Search Report for co-pending International Application No. PCT/JP2009/057170, dated May 12, 2009 2 pages.

(Continued)

*Primary Examiner* — Jean F Duverne
(74) *Attorney, Agent, or Firm* — Barley Snyder

(57) ABSTRACT

There is provided a lever-type connector capable of improving lock-releasing properties of a lever secured by a lock. The lever-type connector is provided with catches arranged at a connector of a lever, a lock at a rear surface of a wire cover, and a releasing portion at the connector. The lever includes a pair of side plates and a connector for connecting both ends of the side plates to each other, with the lever being rotatably attached to the housing between a release position and a mating position. The wire cover is attached at a rear side of the housing. The lever further includes a catch that is arranged at the connector, which is secured by a lock positioned at a rear surface of the wire cover. The lock prevents the lever from rotating to one side of the wire cover by locking the catch of the lever located at the locked position. A first plate spring of the lock extends from one side of the wire cover to the other side, while a locking portion of the lock is positioned at an end portion of the first plate spring. The locking portion is for securing the catch. A release is arranged at the connector and is used to release the catches secured by the lock.

24 Claims, 10 Drawing Sheets

U.S. PATENT DOCUMENTS

| | | | | |
|---|---|---|---|---|
| 6,863,463 | B2 * | 3/2005 | Matsushita | 403/322.4 |
| 6,863,551 | B2 | 3/2005 | Fukamachi | |
| 6,905,355 | B2 | 6/2005 | Fukamachi | |
| 6,997,725 | B2 | 2/2006 | Stella et al. | |
| 7,137,835 | B2 | 11/2006 | Shiga | |
| 7,234,952 | B2 * | 6/2007 | Sasaki et al. | 439/157 |
| 7,396,240 | B2 * | 7/2008 | Frederiksen et al. | 439/157 |
| 7,438,570 | B2 * | 10/2008 | Mori et al. | 439/157 |
| 7,559,779 | B1 * | 7/2009 | Caines et al. | 439/157 |
| 2005/0245114 | A1 * | 11/2005 | Shiga | 439/157 |

FOREIGN PATENT DOCUMENTS

| | | |
|---|---|---|
| JP | 2003-197309 | 7/2003 |
| JP | 2003-297481 | 10/2003 |
| WO | 2006101816 A1 | 9/2006 |

OTHER PUBLICATIONS

International Preliminary Report cited in co-pending International Application No. PCT/JP2009/057170, dated Dec. 29, 2010, 2 pages.

Written opinion of the International Searching Authority cited in co-pending International Application No. PCT/JP2009/057170, dated Dec. 29, 2010, 3 pages.

* cited by examiner

LEVER-TYPE CONNECTOR

CROSS-REFERENCE TO RELATED APPLICATIONS

This application is a continuation of PCT International Application No. PCT/JP2009/057170, filed Apr. 8, 2009, which claims priority under 35 U.S.C. §119 to Japanese Patent Application No. JP 2008-110544, filed Apr. 21, 2008.

FIELD OF THE INVENTION

The present invention relates to a connector and in particular to a lever-type connector to unite and release from a mating connector by rotation of a lever.

BACKGROUND

In recent years, electric connectors having numerous terminals are being used in the field of automobiles and the like, and are continually become more and more advanced. With an electric connector having numerous terminals, a large force is necessary to mate together connectors and release the connection. Therefore, in the field of automobiles and the like, a lever-type connector to mate with and release from a mating connector utilizing effect of boosting by a lever is used.

In a lever-type connector, mating of the mating connectors and releasing of the mated connectors are performed by rotating the lever. The mating with a mating connector is completed by locating the lever to a mating end position. Additionally, in the lever-type connector, in order to maintain mating of the mating connectors, a lock for preventing the rotation of the lever is provided.

In such a situation, in the lever-type connector in which mating with the mating connector is completed, an external force exerted onto the lock may unintentionally release the lever secured by a lock. Besides, in the lever-type connector, if the lever secured by the lock is released unintentionally, the mating with the mating connector may be in an unstable state.

Accordingly, the lever-type connectors capable of preventing the unintentional release of the lever secured by the lock have conventionally been developed.

As a lever-type connector capable of preventing the unintentional release of the lever secured by the lock, an example shown in FIG. 17 has been known.

A lever-type connector 100 shown in FIG. 17 includes a connector housing 110 for receiving contacts, a lever 120 attached to the connector housing 110 capable of rotation with respect to the connector housing 110, and a wire cover 130 attached on the rear surface side of the connector housing 110.

The lever 120 can be rotated to the left-right direction of FIG. 17. The lever 120 has a pair of assembled leg portions 121 and a connector 122 for connecting both of the assembled leg portions 121. Also, there are provided, at both of the assembled leg portions 121, cam grooves 123 for bringing into and pushing out cam pins 210, respectively. There is provided, at the connector 122, a lock 124 with which a catch 111 arranged at the connector housing 110 is locked. An end portion of the lock 124 has a release operation portion 125.

The rear surface of the wire cover 130 has an erroneous release regulator 131 formed to bulge rearwards.

In the lever-type connector 100, by rotating the lever 120 towards a locked position (see FIG. 17), the cam grooves 123 in both of the assembled leg portions 121 bring the cam pins 210 of the mating connector 200, respectively. Then, in the lever-type connector 100, by locating the lever 120 at the locked position, the mating with the mating connector 200 is completed. In the lever-type connector 100 in which the lever 120 is located at the locked position, the catch 111 of the connector housing 110 secures the lock 124 of the connector 122, whereby the lever 120 is locked.

Furthermore, in the lever-type connector 100 in which the lever 120 is locked, the erroneous release regulator 131 of the wire cover 130 does not easily allow an external force to be exerted onto the release operation portion 125 of the lock 124 in the lever 120. In the lever-type connector 100, this prevents the unintentional release, exerted by an external force, of the lever 120 secured by the lock 124 with the catch 111 of the connector housing 110.

In general, when the lever-type connector is assembled, the lever is positioned at the locked position and the lever is secured by the lock in order to prevent the lever from being damaged during transportation.

Then, when the lever-type connector and the mating connector are mated with each other, firstly, the lever secured by the lock is released, and then the lever located at the locked position is rotated to the released position. It is necessary to temporarily mate the lever-type connector with the mating connector when the lever is located at the released position.

It should be noted, however, that in the lever-type connector 100 shown in FIG. 17, in order to release the lever 120, it is necessary to insert a finger into the inside of the release operation portion 125 from the rear side of the wire cover 130 and rotate the lever 120 towards the released position while pulling the release operation portion 125 rearwards with the inserted finger. That is to say, in the lever-type connector 100, when the lever 120 is released, it is necessary to perform the operation of inserting a finger into the inside of the release operation portion 125, the operation of pulling the release operation portion 125 with the finger, and the operation of rotating the lever 120 with the finger. Accordingly, in the lever-type connector 100, there is a drawback in that the lock-releasing properties of the lever 120 are poor. Also, when the lock-releasing properties of the lever 120 are poor, there is the possibility that the working efficiency of an operator is degraded and the operator may damage the lever 120.

SUMMARY

The present invention has been made to address the above-described conventional drawbacks, and has an object of providing a lever-type connector capable of improving the lock-releasing properties of the lever secured by a lock.

The lever-type connector is provided with catches arranged at a connector of a lever, a lock at a rear surface of a wire cover, and a releasing portion at the connector. The lever includes a pair of side plates and a connector for connecting both ends of the side plates to each other, with the lever being rotatably attached to the housing between a release position and a mating position. The wire cover is attached at a rear side of the housing. The lever further includes a catch that is arranged at the connector, which is secured by a lock positioned at a rear surface of the wire cover. The lock prevents the lever from rotating to one side of the wire cover by locking the catch of the lever located at the locked position. A first plate spring of the lock extends from one side of the wire cover to the other side, while a locking portion of the lock is positioned at an end portion of the first plate spring. The locking portion is for securing the catch. A release is arranged at the connector and is used to release the catches secured by the lock.

BRIEF DESCRIPTION OF THE DRAWINGS

The invention is described in more detail in the following with reference to the embodiments shown in the drawings.

Similar or corresponding details in the Figures are provided with the same reference numerals. The invention will be described in detail with reference to the following figures of which.

DETAILED DESCRIPTION OF THE EMBODIMENT(S)

A lever-type connector 1 according to the invention will be described with reference to the accompanying drawings.

A lever-type connector 1 shown in FIGS. 1 to 7 is provided with a housing 10 for receiving multiple contacts (not shown), a wire cover 20 attached at the rear surface side (upper side in FIG. 1 to FIG. 6) of the housing 10, and a lever 30 attached to the wire cover 20.

Figure 3:
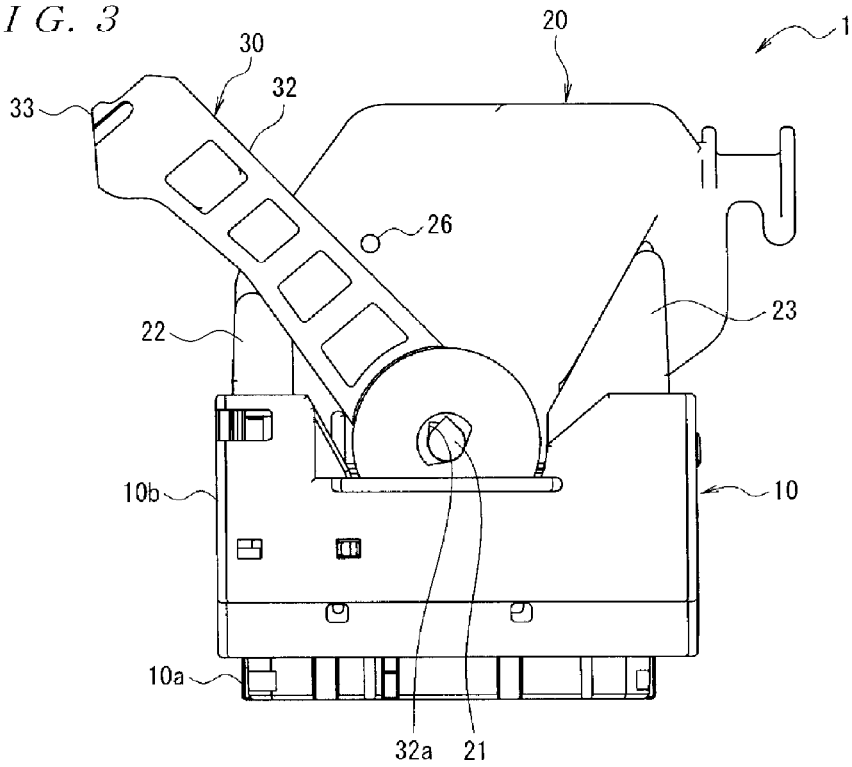
FIG. 3 is a plan view of the lever-type connector shown in FIG. 1.
Figure 4:
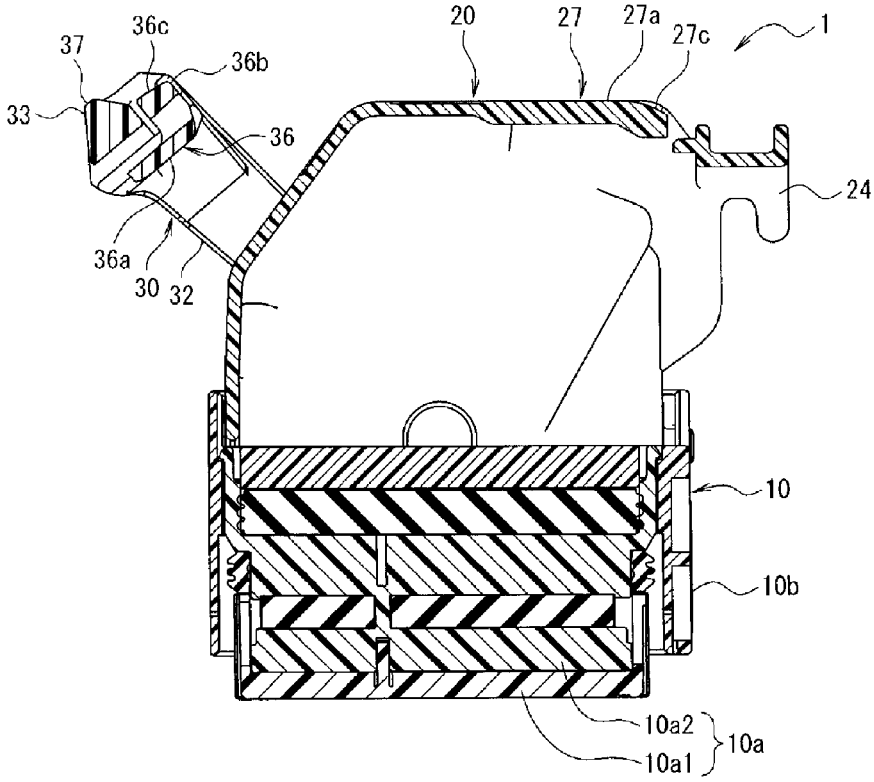
FIG. 4 is a cross-sectional view of a lever of the lever-type connector shown in FIG. 1.
Figure 5:
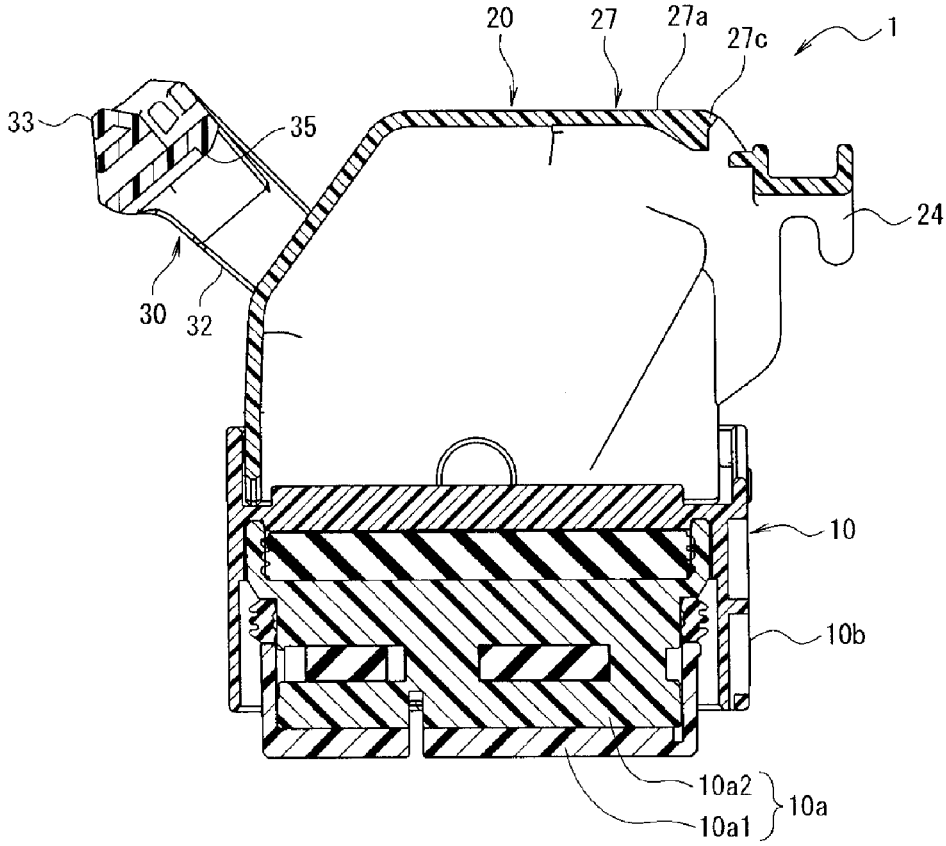
FIG. 5 is a cross-sectional view of a catch of the lever of the lever-type connector shown in FIG. 1.

Referring to FIG. 3 to FIG. 5, the housing 10 is formed to extend in the left-right direction, and has an inner housing 10*a* and an outer housing 10*b* that covers the inner housing 10*a*.

As shown in FIG. 4 and FIG. 5, the inner housing 10*a* includes an inner housing main body 10*a*2, and a front cover 10*a*1 arranged at the front surface of the inner housing main body 10*a*2. The inner housing 10*a* has multiple contact receiving passageways (not shown) that penetrate through the inner housing 10*a* in the front-rear direction.

Figure 8:
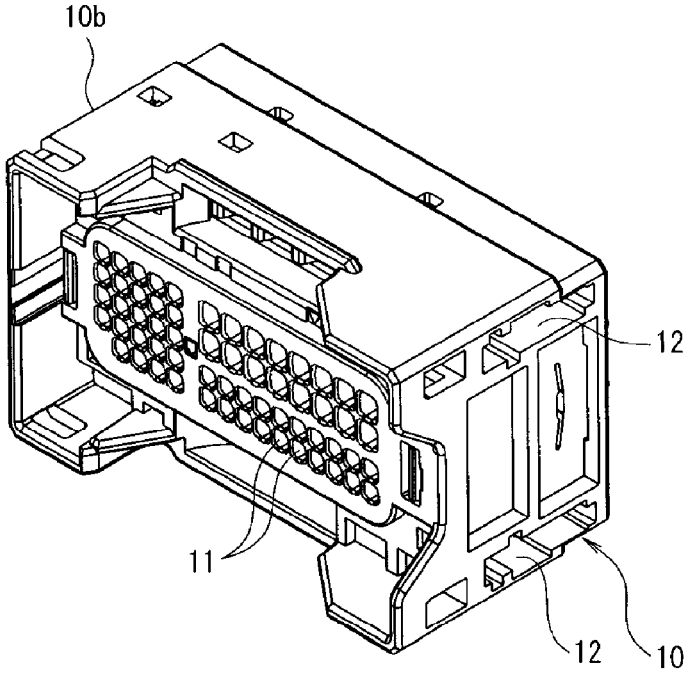
FIG. 8 is a perspective view of a housing of the lever-type connector shown in FIG. 1.
Figure 9:
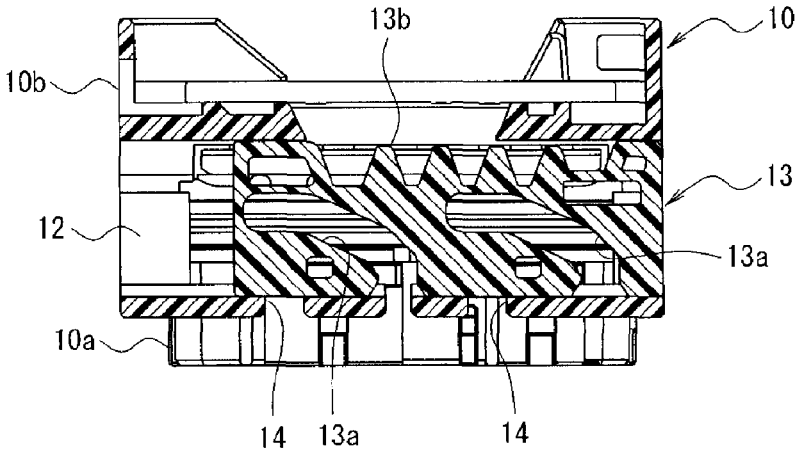
FIG. 9 is a cross-sectional view of the housing shown in FIG. 8.
Figure 10:
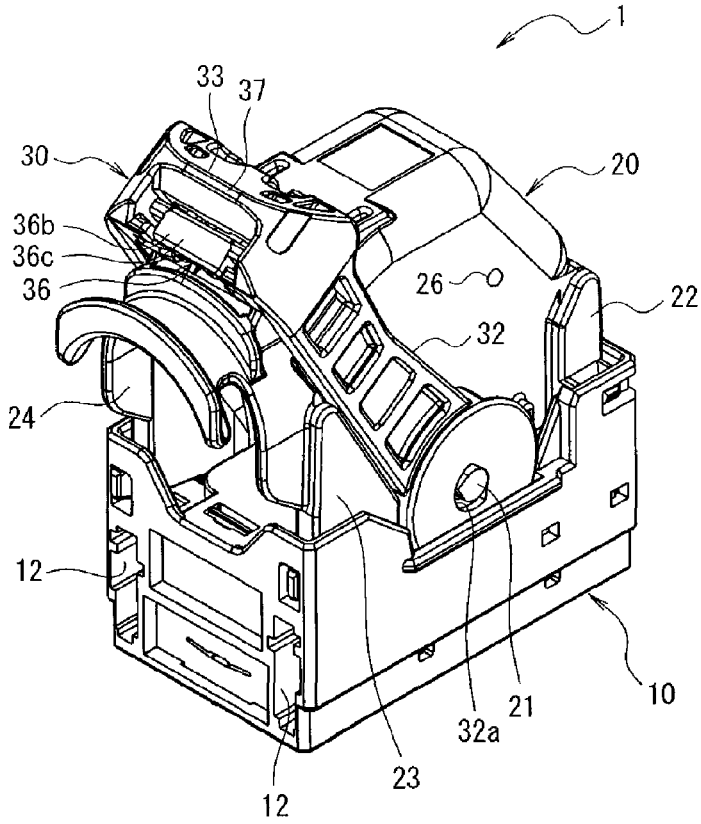
FIG. 10 is a perspective view of the right side of the lever-type connector according to the invention with the lever located at a locked position.
Figure 11:
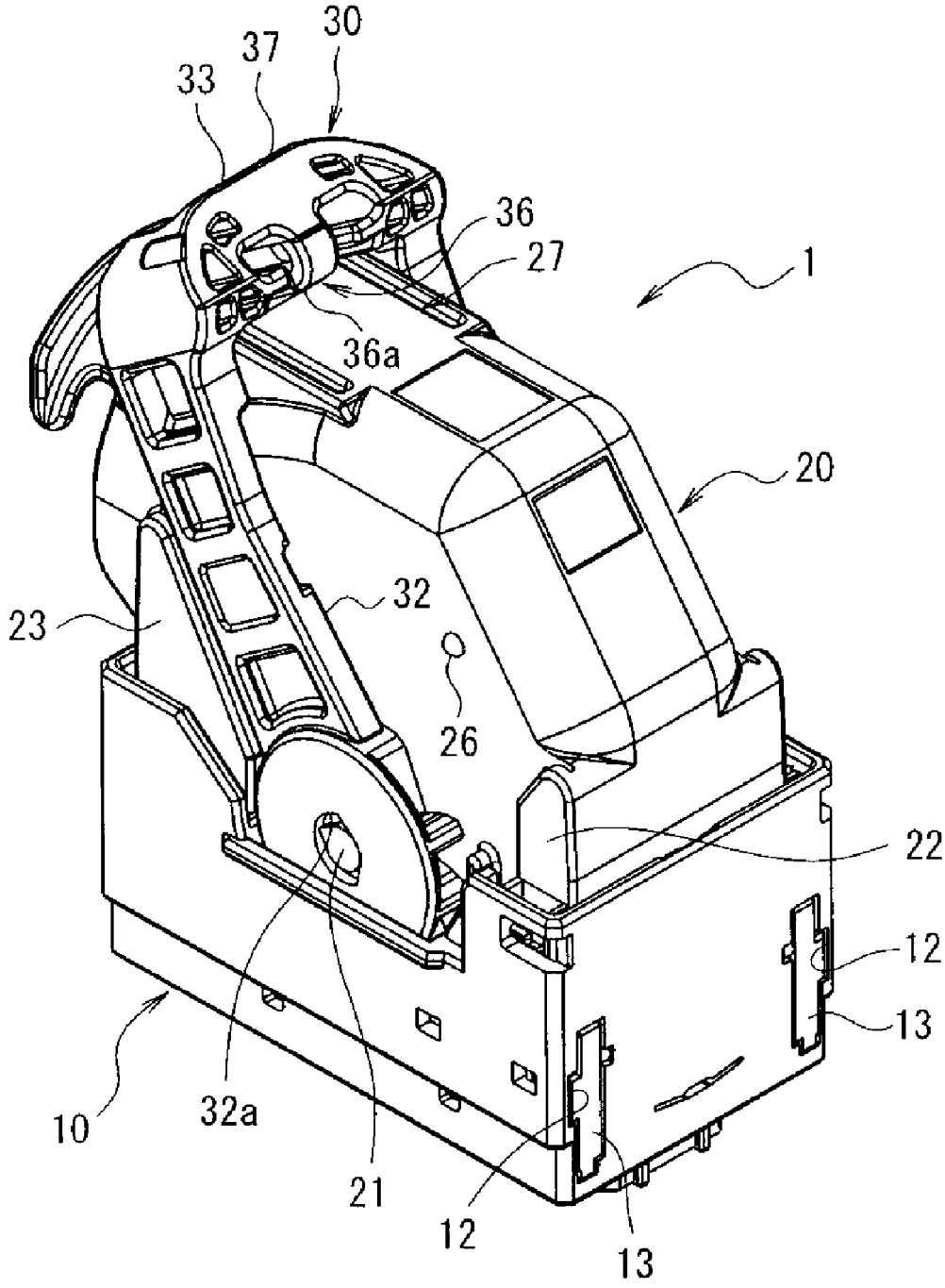
FIG. 11 is a perspective view illustrative of the left side of the lever-type connector shown in FIG. 10.
Figure 12:
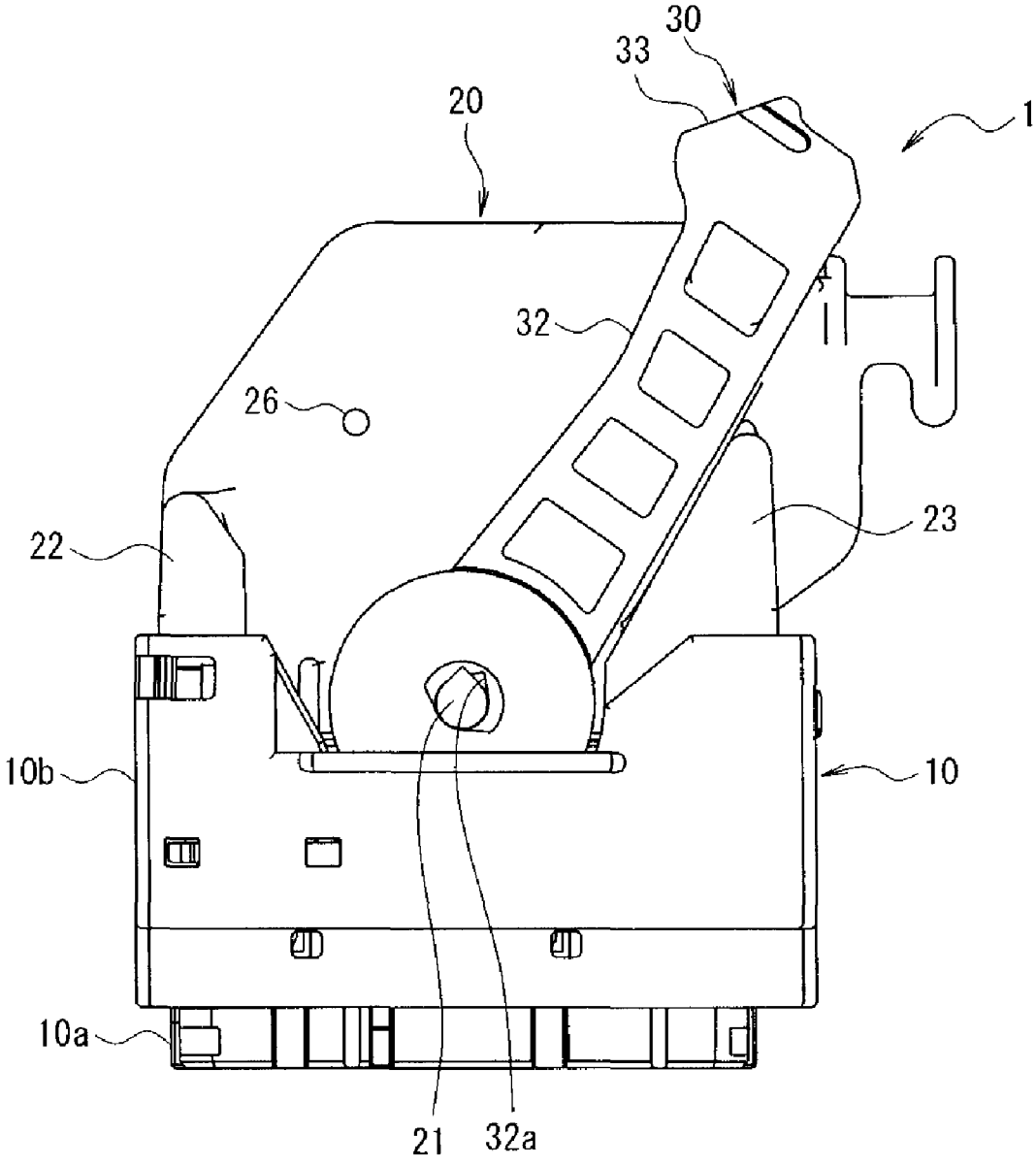
FIG. 12 is a plan view of the lever-type connector shown in FIG. 10.

Referring now to FIG. 8 and FIG. 9, slider receiving grooves 12 each extending in the left-right direction are arranged at both inner side surfaces in the vertical direction of the outer housing 10*b*. Specifically, as shown in FIG. 9, each slider receiving groove 12 receives a slider 13. Each slider 13 is received in the slider receiving groove 12 for free movement in the left-right direction.

As shown in FIG. 9, the front surface of the outer housing 10*b* has cam pin insertion holes 14 into which cam pins (not shown) arranged at the mating connector are inserted, respectively. As shown in FIG. 8, a contact insertion hole 11 communicates with each contact receiving passageway of the inner housing 10*a* and is arranged at the rear surface of the outer housing 10*b*.

Each slider 13 is formed to have a plate shape and extends in the left-right direction, as shown in FIG. 9. The inner surface of each slider 13 has two cam grooves 13*a*, for bringing into and pushing the cam pins arranged at the mating connector, in the left-right direction. Also, a rack 13*b* fit with a gear 32*b* (see FIG. 1) of the lever 30 is arranged on the rear surface side of each slider 13.

Figure 1:
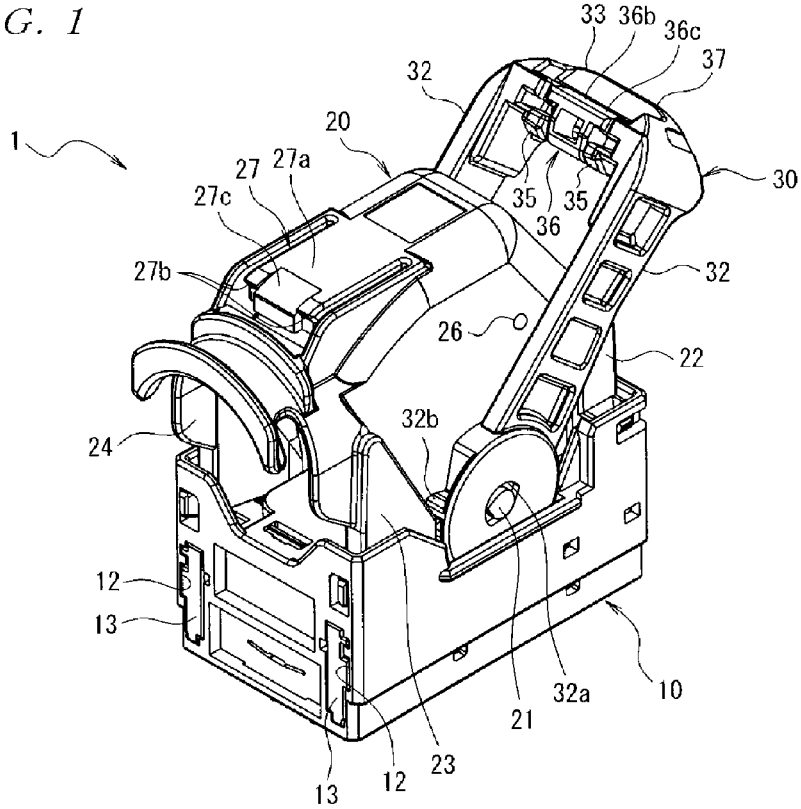
FIG. 1 is a perspective view of a right side of a lever-type connector according to the invention set to a released position.
Figure 6:
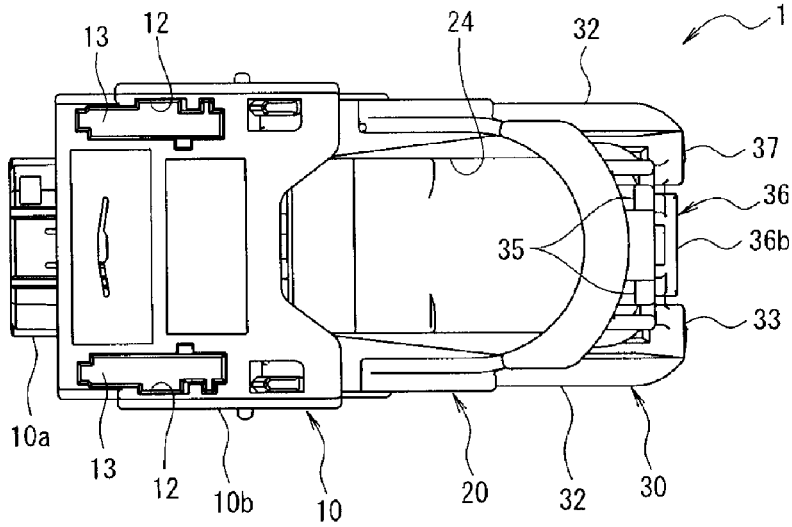
FIG. 6 is a right side view of the lever-type connector shown in FIG. 1.
Figure 7:
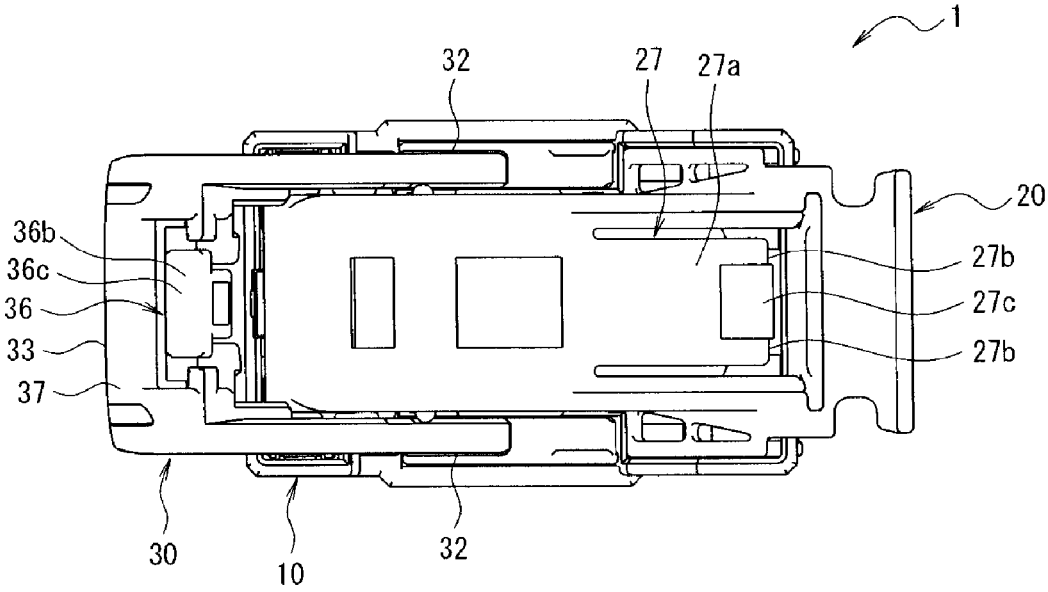
FIG. 7 is a rear view of the lever-type connector shown in FIG. 1.

The lever 30 has a pair of side plates 32 and a connector 33 for connection one ends of both of the side plates 32 with each other, as shown in FIG. 1 and FIG. 7. The other ends of both of the side plates 32 each has a shaft receiving hole 32*a* into which a shaft 21 of the wire cover 20 is fit. Additionally, the lever 30 is attached to the wire cover 20 to be capable of rotating in the left-right direction of the housing 10 with the shaft receiving holes 32*a* of the side plates 32 being as the center. The lever 30 can rotate between the released position (see FIG. 1 to FIG. 7) and the locked position (see FIG. 10 to FIG. 16). Also, as shown in FIG. 1, the gear 32*b* engaged with the rack 13*b* of each slider 13 is arranged around the shaft receiving hole 32*a* at each of the other ends of both side plates 32.

As shown in FIG. 1, FIG. 5, and FIG. 6, two catches 35 are positioned on the inner side of the connector 33, by which two locking portions 27*b* of a lock 27 in the wire cover 20 are secured, respectively. Both catches 35 protrude inwards.

Figure 13:
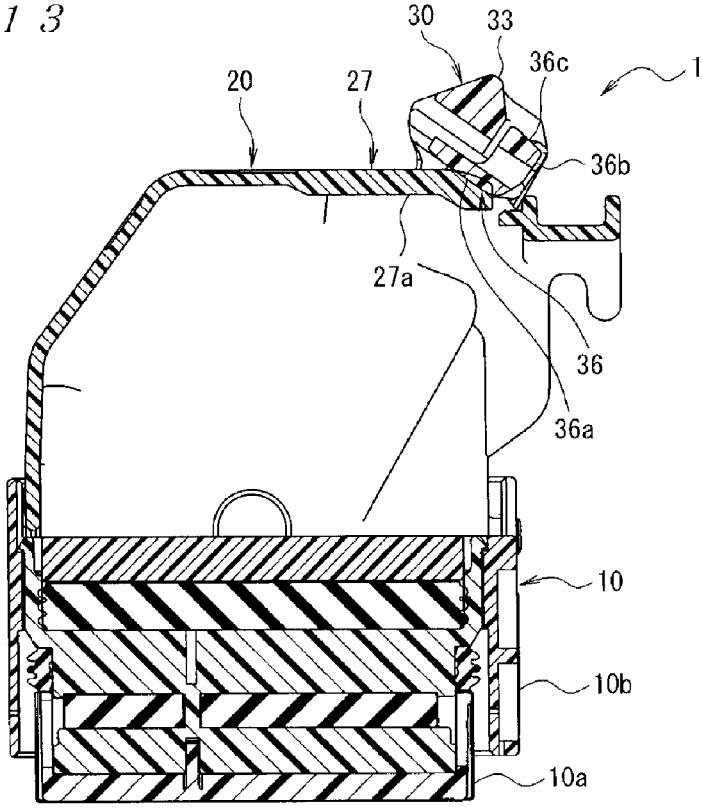
FIG. 13 is a cross-sectional view of the lever of the lever-type connector shown in FIG. 10.

As shown in FIG. 1, FIG. 4, and FIG. 6, there is provided, on the inner side of the connector 33, a release 36 for releasing the catches 35 secured to the locking portions 27*b* of the lock 27. The release 36 has a second plate spring 36*a* extending from the left side surface to the right side of the connector 33 (the other end side in the left-right direction); and a releasing projection 36*b* extending outwards from an end portion of the second plate spring 36*a*. The second plate spring 36*a* is formed to have a blade shape of cantilever. As shown in FIG. 1 and FIG. 6, the end portion of the second plate spring 36*a* is located between both catches 35. Referring to FIG. 13, the second plate spring 36*a* is provided to extend rightwards and frontwards (diagonally forwards) from the connector 33 with the lever 30 located at the locked position. Then, the end portion of the second plate spring 36*a* is located on the rear side of a release surface 27*c* of a first plate spring 27*a* of the lock 27 with the lever 30 located at the locked position. An end portion of the releasing projection 36*b* has a slant face 36*c*. Referring now to FIG. 13, the slant face 36*c* is arranged to face rightwards and the rearwards with the lever 30 located at the locked position. That is to say, the perpendicular line to the slant face 36*c* virtually extends from the right side and the rear side to the left side and the front side with the lever 30 located at the locked position.

Side walls 37 are provided around the releasing projection 36*b* arranged outside of the connector 33. The side walls 37 are arranged on the upper side, lower side, and left side (one side in the left-right direction) of the releasing projection 36*b*. The side walls 37 are provided to protrude outwards from the releasing projection 36*b*.

Figure 2:
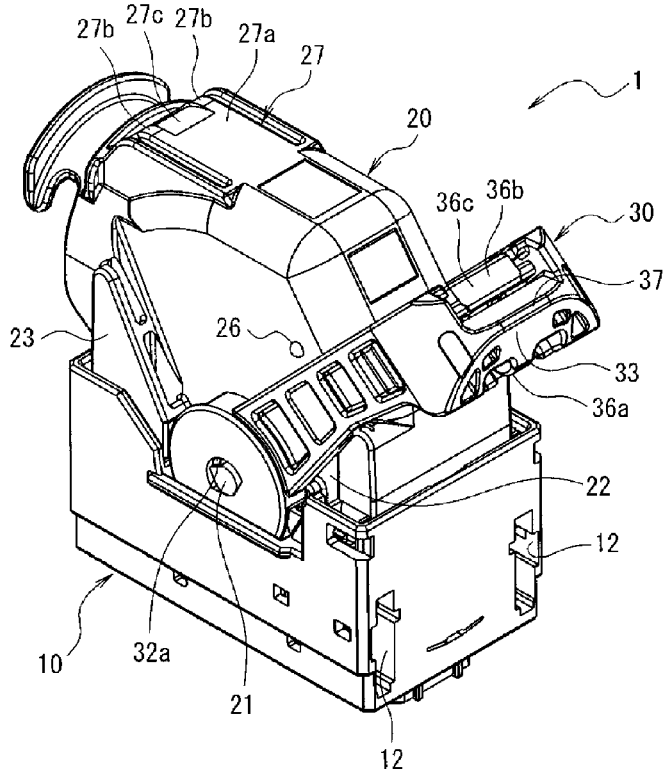
FIG. 2 is a perspective view of the left side of the lever-type connector shown in FIG. 1.

As shown in FIG. 1 and FIG. 2, the wire cover 20 is formed to have a substantially box shape, and receives electrical wires (not shown) extending from the contacts received in the contact receiving passageways of the inner housing 10*a*. The front end portion of the upper surface and lower surface in the wire cover 20 has the shaft 21 to be fit in the shaft receiving hole 32*a* of the lever 30. Also, the upper surface and the lower surface of the wire cover 20 have locking projections 26, respectively, for locking the lever 30 arranged at the released position. Each of the locking projections 26 is locked to the side surface of each side plate 32 of the lever 30 located at the released position, thereby preventing the rotation of the lever 30 to the right side.

As shown in FIG. 1 and FIG. 2, a first stopper 22 is arranged on the left side of the wire cover 20. Also, a second stopper 23 is arranged on the right side of the wire cover 20. The first stopper 22 deters the lever 30 located at the released position from further rotating to the left side. The second stopper 23 deters the lever 30 located at the locked position from further rotating to the right side. There is provided, at an end portion on the right side of the wire cover 20, an electrical wire withdrawing outlet 24 for withdrawing the electrical wires connected to the contacts received in the housing 10 with the electrical wires bundled.

Figure 14:
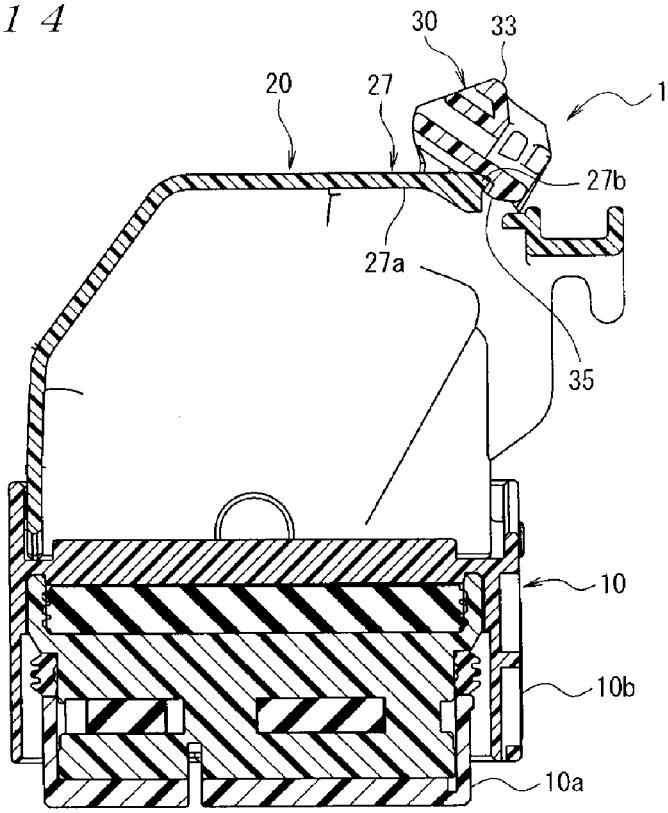
FIG. 14 is a cross-sectional view of the catch of the lever of the lever-type connector shown in FIG. 10.
Figure 15:
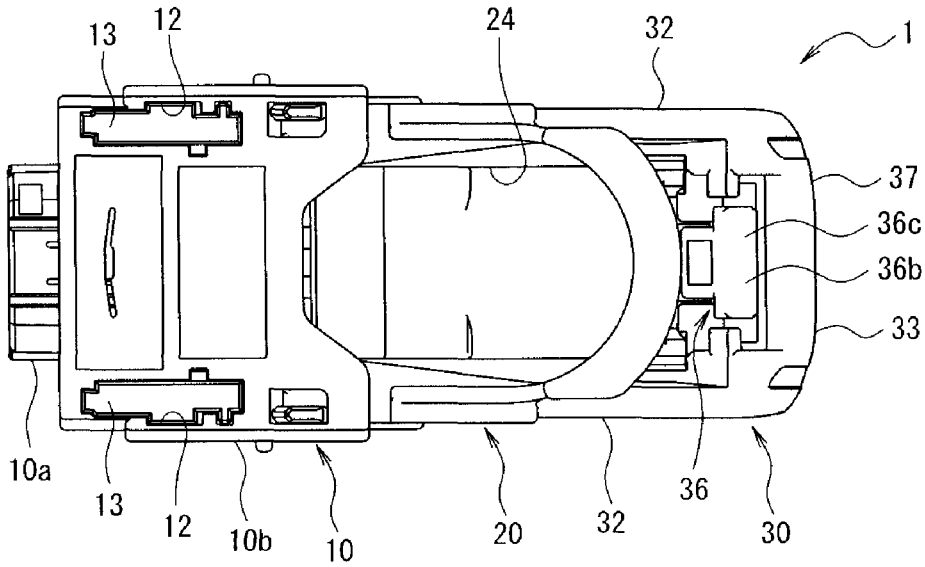
FIG. 15 is a right side view of the lever-type connector shown in FIG. 10.
Figure 16:
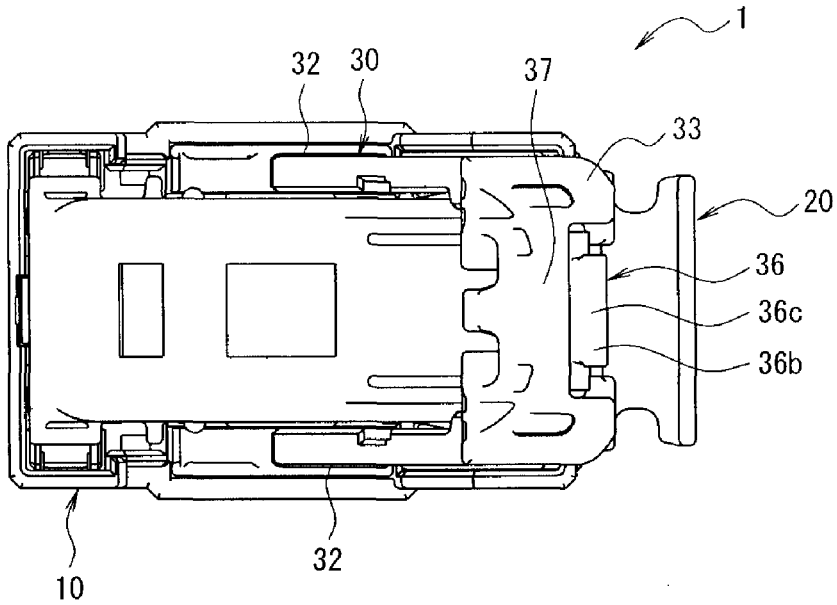
FIG. 16 is a rear view of the lever-type connector shown in FIG. 10.
Figure 17:
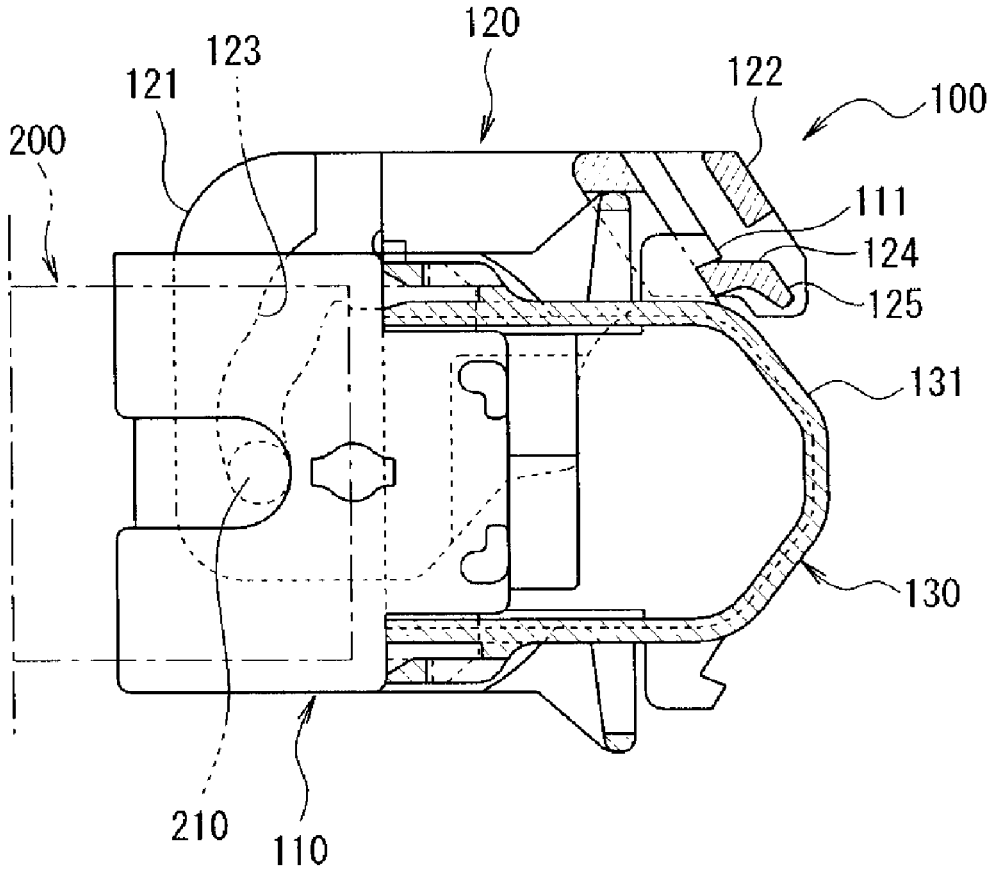
FIG. 17 is a cross-sectional view of a known lever-type connector.

As shown in FIG. 1 and FIG. 7, the rear surface of the wire cover 20 is provided with the lock 27 for inhibiting the rotation of the lever 30 located at the locked position to the left side. The lock 27 includes a first plate spring 27*a* extending to the right side from the wire cover 20, and two locking portions 27*b* arranged at an end portion of the first plate spring 27*a*. The first plate spring 27*a* has a blade shape of a cantilever. Both of the locking portions 27*b* are respectively arranged at end portions in the vertical direction of the first plate spring 27*a*. The release surface 27*c* is arranged between both of the locking portions 27*b* at the end portion of the first plate spring 27*a*. The release surface 27*c* is tilted with respect to the rear surface of the wire cover 20 to face rearwards and rightwards, as shown in FIG. 4. The lock 27 inhibits the rotation of the lever 30 to the left side, as shown in FIG. 14, when both of the locking portions 27*b* are secured by catches 35, respectively, of the lever 30 located at the locked position.

Subsequently, use of the lever-type connector 1 will be described.

In the lever-type connector 1, by rotating the lever 30 with respect to the housing 10, the gear 32*b* of the lever 30 actuates the rack 13*b* of the slider 13 and moves the slider 13 in the left-right direction. Then, when the lever 30 is rotated toward the released position side (one side in the left-right direction), the slider 13 moves to the right side. Additionally, when the lever 30 is rotated toward the locked position side (the other end in the left-right direction), the slider 13 moves to the left side.

In this situation, as shown in FIG. 10 to FIG. 16, the lever 30 is located at the locked position and is secured by the lock 27.

Accordingly, when the lever-type connector 1 connects with a mating connector, firstly, it is necessary to release the lever 30 secured by the lock 27 and rotate the lever 30 located at the locked position to locate the lever 30 at the released position.

When the lever 30 secured by the lock 27 is released, the slant face 36*c* of the releasing projection 36*b* in the lever 30 is pushed in an orthogonal direction of the slant face 36*c*. After that, the second plate spring 36*a* of the lever 30 bends and the end portion of the second plate spring 36*a* is displaced inwards. Then, the end portion of the second plate spring 36*a* displaced inwards is brought into contact with the release surface 27*c* of the first plate spring 27*a* in the lock 27. When the releasing projection 36*b* of the lever 30 is further pushed inwards, the end portion of the second plate spring 36*a* pushes the release surface 27*c* of the lock 27 inwards. Thus, the first plate spring 27*a* of the lock 27 bends and both of the locking portions 27*b* arranged at the end portion of the first plate spring 27*a* are displaced inwards. Both of the locking portions 27*b* of the lock 27 are displaced inwards, thereby releasing the locking of the catches 35 in the lever 30 secured by both of the locking portions 27*b*. Subsequently, by rotating the lever 30 to the left side with a finger that has pushed the releasing projection 36*b* of the lever 30, it is made possible to release the lever 30 secured by the lock 27. In other words, in the lever-type connector 1, the release of the lever 30 secured by the lock 27 can be achieved by a series of operations of pushing the releasing projection 36*b* and rotating the lever 30. Accordingly, in the lever-type connector 1, it is made possible to improve the lock-releasing properties of the lever 30 secured by the lock 27.

Referring now to FIG. 13, the second plate spring 36*a* of the release 36 in the lever 30 is arranged to extend rightwards and frontwards (diagonally forwards) from the connector 33 with the lever 30 located at the locked position. Thus, the end portion of the second plate spring 36*a* by pushing the releasing projection 36*b* of the lever 30 inwards is displaced frontwards and leftwards with respect to the position of the end portion of the second plate spring 36*a* prior to the displacement. Accordingly, by merely pushing the releasing projection 36*b* of the lever 30 inwards, it is possible to release the catches 35 of the lever 30 secured to both of the locking portions 27*b* of the lock 27, and in addition, it is made possible to rotate the lever 30 in which the locking is released to the left side. It is therefore possible to further improve the lock-releasing properties of the lever 30.

In addition, the slant face 36*c* facing rightwards and rearwards is provided at the end portion of the releasing projection 36*b*. Therefore, when the lever 30 secured by the lock 27 is released, by pushing the slant face 36*c* of the releasing projection 36*b* in a direction orthogonal to the slant face 36*c*, it is made possible to displace the end portion of the second plate spring 36*a* frontwards and leftwards in a smooth manner. It is therefore possible to further improve the lock-releasing properties of the lever 30 secured by the lock 27.

Then, after the lever 30 secured by the lock 27 is released, the lever 30 is rotated to be located at the released position. When the lever 30 is located at the released position, each cam pin insertion hole 14 of the outer housing 10*b* is communicated with each cam groove 13*a* of each slider 13. Furthermore, the rotation of the lever 30 located at the released position to the locked position side is inhibited by the locking projections 26 of the wire cover 20.

Next, with the lever 30 located at the released position, each cam pin of the mating connector is inserted into each cam groove 13*a* of each slider 13 through each cam pin insertion hole 14 of the outer housing 10*b*, so the lever-type connector 1 and the mating connector are temporarily mated.

Subsequently, the lever 30 secured by the locking projections 26 of the wire cover 20 is released to cause the lever 30 located at the released position to rotate towards the locked position side. When the lever 30 is rotated towards the locked position side, multiple cam grooves 13*a* of the slider 13 bring cam pins provided at the mating connector into the rear surface side, respectively. Thus, multiple contacts received in the inner housing 10*a* of the lever-type connector 1 mate with the contacts received in the mating connector.

Then, by locating the lever 30 at the locked position, connection of the lever-type connector 1 and the mating connector is completed. Incidentally, the lever 30 located at the locked position is in the state where the rotation to the released position side is inhibited by the lock 27 of the wire cover 20.

In this state, the side walls 37 that protrude outwards from the releasing projection 36*b* are arranged around the releasing projection 36*b* of the connector 33 in the lever 30. This allows the lever-type connector 1 to prevent unintentional lever 30, when an external force is exerted onto the releasing projection 36*b*.

Meanwhile, when connection of the lever-type connector 1 with the mating connector is released, the lever 30 secured by the lock 27 of the wire cover 20 is released, and then the lever 30 located at the locked position is rotated towards the released position side. Incidentally, releasing the lever 30 secured by the lock 27 has already been described.

When the lever 30 is rotated towards the released position side, multiple cam grooves 13*a* of the slider 13 push the cam pins arranged at the mating connector to the front surface side, respectively. This releases the mating of the contacts received in the inner housing 10*a* of the lever-type connector 1 with the contacts received in the mating connector.

Then, when the lever 30 is rotated to the released position, release of the connecting lever-type connector 1 and mating connector is completed.

With a lever-type connector according the invention, it is possible to improve the lock-releasing properties of the lever. In addition, with the above lever-type connector, it is possible to prevent unintentional lever by an external force exerting on the releasing projection.

While the embodiments of the present invention have been illustrated in detail, various modifications to those embodiments are possible. Those skilled in the art will appreciate that various modifications, additions and substitutions are possible, without departing from the scope and spirit of the invention as disclosed in the accompanying claims.

For example, in the above embodiments, two catches 35 are provided at the connector 33 and two locking portions 27*b* are provided at the lock 27 of the wire cover 20. However, one catch 35 may be provided at the connector 33 and one locking portion lock 27 may be provided at the lock 27 of the wire cover 20.

What is claimed is:

1. A lever-type connector comprising:

a housing having contact receiving passageways extending in front-rear direction;

a lever having a pair of side plates and a connector for connecting both ends of the side plates to each other, the lever being rotatable attached to the housing between a release position and a locked position;

a wire cover attached at a rear side of the housing;

a catch arranged at the connector;

a lock at a rear surface of the wire cover for preventing the lever from rotating to one side of the wire cover by locking the catch of the lever located at the locked position;

a first plate spring of the lock extending from one side of the wire cover to another side;

a locking portion of the lock at an end portion of the first plate spring for locking the catch; and a release positioned at the connector of the lever, having a second plate spring extending from the connector on an adjacent side and a releasing projection extending outwards from an end portion of the second plate spring, the release releases the catch secured by the lock, wherein the releasing portion pushes the end portion of the first plate spring by pushing the releasing projection inwards with the locking portion being secured by the catch.

2. The lever-type connector according to claim 1, wherein the second plate spring is arranged to extend diagonally forwards from the connector with the lever located at the locked position.

3. The lever-type connector according to claim 1, wherein the end portion of the releasing projection has a slant face.

4. The lever-type connector according to claim 1, wherein side walls are arranged around a releasing projection of the connector to protrude outwards from the releasing projection.

5. The lever-type connector according to claim 1, wherein side walls are arranged around the releasing projection of the connector to protrude outwards from the releasing projection.

6. The lever-type connector according to claim 5, wherein the side walls are arranged on an upper side, lower side, and left side of the releasing projection.

7. The lever-type connector according to claim 1, further comprising a first stopper on one side of the wire cover.

8. The lever-type connector according to claim 7, further comprising a second stopper on an other side of the wire cover.

9. The lever-type connector according to claim 8, wherein the first stopper deters the lever located at the released position from further rotation while the second stopper deters the lever located at the locked position from further rotation.

10. The lever-type connector according to claim 1, wherein first plate spring is a blade shaped cantilever.

11. The lever-type connector according to claim 1, further comprising a release surface between two locking portions.

12. The lever-type connector according to claim 1, wherein the release surface is tilted with respect to the rear surface of the wire cover to face rearwards and rightwards.

13. A lever-type connector comprising:

a housing having contact receiving passageways extending in front-rear direction;

a lever having a pair of side plates and a connector for connecting both ends of the side plates to each other, the lever being rotatably attached to the housing between a release position and a locked position;

a wire cover attached at a rear side of the housing;

a catch arranged at the connector;

a lock at a rear surface of the wire cover for preventing the lever from rotating to one side of the wire cover by locking the catch of the lever located at the locked position;

a first plate spring of the lock extending from one side of the wire cover to another side;

a locking portion of the lock at an end portion of the first plate spring for locking the catch;

a release positioned at the connector of the lever, the release releases the catch secured by the lock;

a first stopper on one side of the wire cover; and a second stopper on an other side of the wire cover, wherein the first stopper deters the lever located at the released position from further rotation while the second stopper deters the lever located at the locked position from further rotation.

14. The lever-type connector according to claim 13, wherein the release includes a second plate spring extending from the connector an adjacent side.

15. The lever-type connector according to claim 14, wherein the second plate spring is arranged to extend diagonally forwards from the connector with the lever located at the locked position.

16. The lever-type connector according to claim 14, wherein the release further includes a releasing projection extending outwards from an end portion of the second plate spring.

17. The lever-type connector according to claim 16, wherein the releasing portion pushes the end portion of the first plate spring by pushing the releasing projection inwards with the locking portion being secured by the catch.

18. The lever-type connector according to claim 13, wherein the end portion of the releasing projection has a slant face.

19. The lever-type connector according to claim 13, wherein side walls are arranged around a releasing projection of the connector to protrude outwards from the releasing projection.

20. The lever-type connector according to claim 16, wherein side walls are arranged around the releasing projection of the connector to protrude outwards from the releasing projection.

21. The lever-type connector according to claim 20, wherein the side walls are arranged on an upper side, lower side, and left side of the releasing projection.

22. The lever-type connector according to claim 13, wherein first plate spring is a blade shaped cantilever.

23. The lever-type connector according to claim 13, further comprising a release surface between two locking portions.

24. The lever-type connector according to claim 13, wherein the release surface is tilted with respect to the rear surface of the wire cover to face rearwards and rightwards.

* * * * *